US011220775B2

(12) United States Patent
Han

(10) Patent No.: US 11,220,775 B2
(45) Date of Patent: Jan. 11, 2022

(54) WASHING MACHINE AND CONTROL METHOD THEREOF

(71) Applicant: LG ELECTRONICS INC., Seoul (KR)

(72) Inventor: Sang-hyup Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/986,634

(22) Filed: Aug. 6, 2020

(65) Prior Publication Data

US 2021/0115612 A1 Apr. 22, 2021

(30) Foreign Application Priority Data

Oct. 21, 2019 (KR) ..... 10-2019-0130780

(51) Int. Cl.

| | |
|---|---|
| ***D06F 34/22*** | (2020.01) |
| ***D06F 35/00*** | (2006.01) |
| ***D06F 39/02*** | (2006.01) |
| *D06F 103/20* | (2020.01) |

(52) U.S. Cl.
CPC ..... *D06F 34/22* (2020.02); *D06F 35/006* (2013.01); *D06F 39/02* (2013.01); *D06F 2103/20* (2020.02)

(58) Field of Classification Search
CPC ..... D06F 37/40
See application file for complete search history.

(56) References Cited

U.S. PATENT DOCUMENTS

| | | | |
|---|---|---|---|
| 2010/0139366 | A1 | 6/2010 | Krausch |
| 2012/0005842 | A1 | 1/2012 | Schulze |

FOREIGN PATENT DOCUMENTS

| | | | |
|---|---|---|---|
| DE | 10 2007 015 246 | A1 | 10/2008 |
| DE | 10 2014 224 728 | B3 | 6/2016 |
| DE | 10 2018 108 775 | A1 | 10/2019 |
| KR | 10-2009-0013520 | A | 2/2009 |
| KR | 10-2010-0023321 | A | 3/2010 |
| KR | 10-2018-0079969 | | 7/2018 |
| KR | 10-2018-0080013 | | 7/2018 |

OTHER PUBLICATIONS

Extended European Search Report dated Jan. 13, 2021 issued in Application 20189514.1.

*Primary Examiner* — Jason Y Ko
(74) *Attorney, Agent, or Firm* — KED & Associates, LLP

(57) ABSTRACT

A washing machine may reflect a preference of a user regarding use of an additive. The washing machine may include an additive supplying part coupled to a washing tub to supply an additive to the washing tub, a concentration sensor configured to sense a scent concentration of an additive measured in the washing tub, and a controller configured to switch the washing tub to an additional laundry cycle mode according to the scent concentration sensed by the concentration sensor.

7 Claims, 7 Drawing Sheets

WASHING MACHINE AND CONTROL METHOD THEREOF

CROSS-REFERENCE TO RELATED APPLICATION

This application claims priority under 35 U.S.C. § 119 to Korean Application No. 10-2019-0130780 filed on Oct. 21, 2019, whose entire disclosure is hereby incorporated by reference.

BACKGROUND

1. Field

The present disclosure relates to a washing machine and a control method thereof and, more particularly, a washing machine capable of reflecting a preference of a user when an additive is used, and a control method thereof.

2. Background

A washing machine is a machine that washes laundry by using an emulsifying effect of detergent, a frictional force of a water stream made by rotation of a washing blade, and an impact applied by the washing blade. Such washing machines mainly use an electric motor as a main power source, and as the washing, rinsing, and spin-drying processes are performed using the action of detergent and water, contaminants in clothing are separated from the clothing.

As the types of laundry have diversified, methods for doing laundry have also diversified. In particular, various additives such as fabric softeners, as well as detergents, are also used in doing laundry as required by users. Additives used for doing laundry are generally produced to have a scent such that users can experience a feeling of freshness, for example.

However, since people have different sensitivities to smell, some users may not be satisfied with the intensity of the scent of an additive even when a relatively large amount of the additive is used. On the contrary, even when a relatively small amount of additive is added, other users may feel that the scent of the additive is strong. Accordingly, it is necessary to develop a technique for a washing machine characterized in that the amount of an additive added can be appropriately adjusted based on the preference of each user.

Korean Patent Application Publication No. 10-2018-0079969 (hereinafter referred to as "related art 1"), the subject matter of which is incorporated herein by reference, discloses a washing apparatus and a control method thereof. The related art 1 discloses a washing apparatus characterized in that a detergent is automatically supplied to a washing tub by using a detergent supply box which is easily detachable. However, in related art 1, the automatic supply of a detergent is facilitated merely by a motor and a pump of the washing device, and no feature is provided for adjusting the supplied amount of detergent based on a preference of a user.

Korean Patent Application Publication No. 10-2018-0080013 (hereinafter referred to as "related art 2"), the subject matter of which is incorporated herein by reference, also discloses a washing apparatus and a control method thereof. Related art 2 discloses a washing apparatus characterized in that a user intuitively checks a remaining amount of a detergent received in a detergent box and an operation related to the supply of the detergent. However, related art 2 does not consider a feature of adjusting the supplied amount of the detergent based on the preference of the user. Although the washing apparatus of related art 2 provides the user with intuitive information, it cannot be deemed that a preference of the user is considered in related art 2.

Existing washing machines have a limitation in that the amount of an additive added is not appropriately adjusted based on the preference of each user.

BRIEF DESCRIPTION OF THE DRAWINGS

The embodiments will be described in detail with reference to the following drawings in which like reference numerals refer to like elements wherein.

DETAILED DESCRIPTION

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

Preferable exemplary embodiments of the present disclosure will be described in detail referring to the attached drawings. In the following description, known functions or features will be omitted in order to clarify the gist of the present disclosure.

Figure 1:
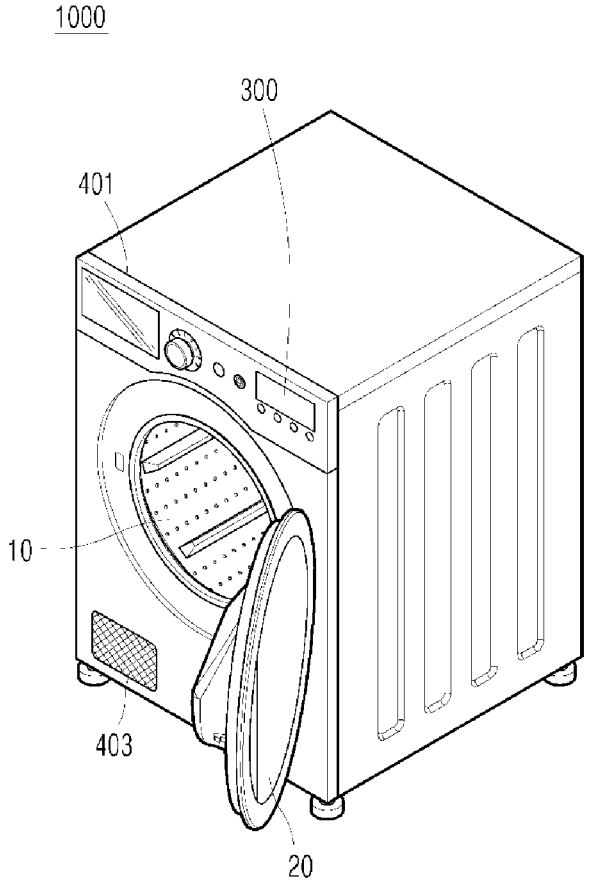
FIG. 1 is a perspective view of an example of a washing machine according to one embodiment of the present disclosure.
Figure 2:
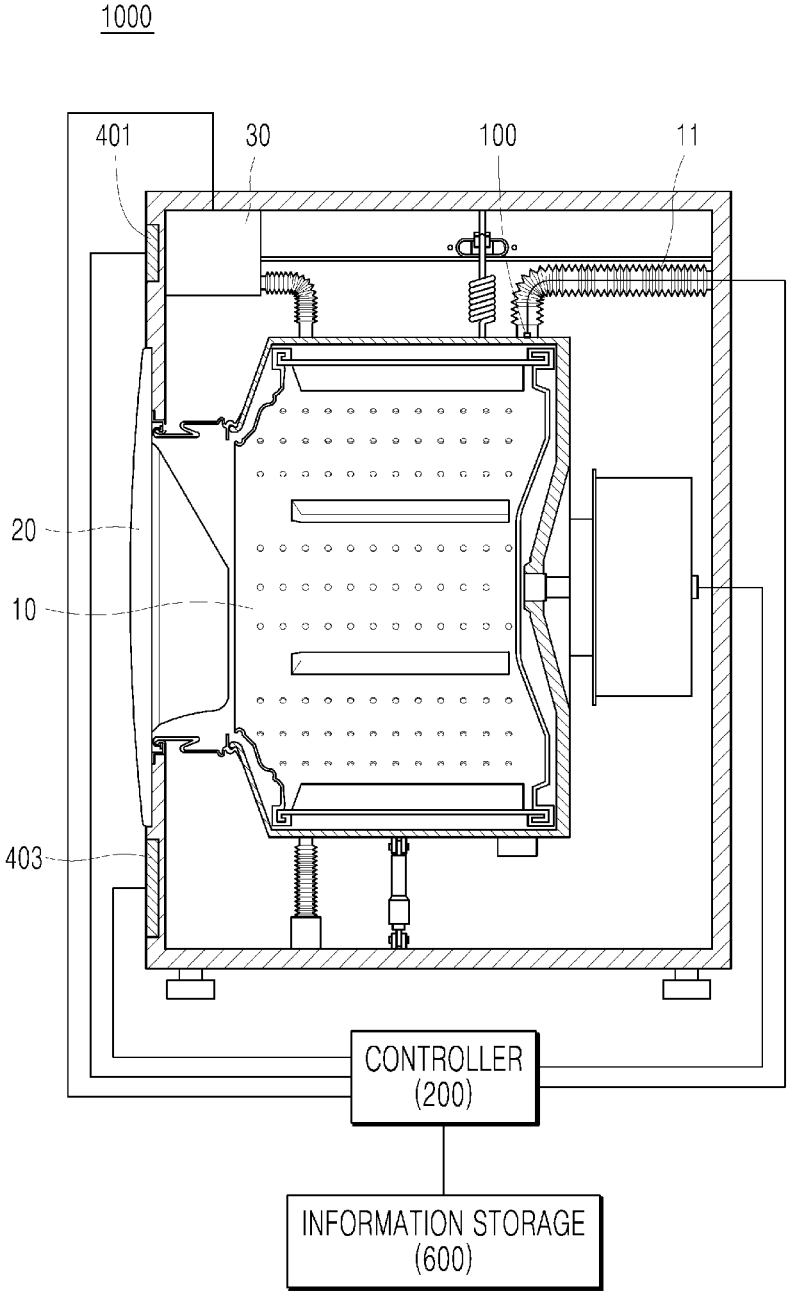
FIG. 2 is a view schematically illustrating main components of the washing machine according to one embodiment of the present disclosure.

FIG. 1 is a perspective view of an example of a washing machine according to one embodiment of the present disclosure. FIG. 2 is a view schematically illustrating main components of the washing machine according to one embodiment of the present disclosure.

A washing machine 1000 according to one embodiment of the present disclosure may include a washing tub 10 and perform at least one of a wash cycle, a rinse cycle, a spin-dry cycle, or an air-dry cycle. The washing tub 10 may be a part performing at least one of the wash cycle, the rinse cycle, the spin-dry cycle, or the air-dry cycle when laundry is received in a receiving space in the washing tub 10, and may include a laundry entrance formed in one surface thereof through which laundry is inserted. The laundry entrance may be configured to be opened and closed by a door 20, and may be sealed by the door 20 while the at least one of the wash cycle, the rinse cycle, the spin-dry cycle, or the air-dry cycle is being performed.

An additive supplying part 30 (or additive supplying device) may be a part that is coupled to the washing tub 10 and supplies an additive to the washing tub 10. The additive supplying part 30 may supply additives such as a detergent, a fabric softener, and a bleaching agent to the washing tub 10 such that various processes for laundry are performed. An additive such as a fabric softener generally has a scent such that a user experiences a feeling of, for example, freshness.

However, since people have different sensitivities to smell, some users may not be satisfied with the intensity of the scent of an additive even when a relatively large amount of the additive is used. On the contrary, even when a relatively small amount of additive is added, other users may feel that the scent of the additive is strong. In order to overcome such a limitation, the washing machine 1000 may include the additive supplying part 30, a concentration sensor 100, and a controller 200, as illustrated in FIGS. 1 and 2.

The concentration sensor 100 may be a part configured to sense concentration of an additive. The concentration sensor 100 may indirectly check the amount of an additive added to the washing tub 10 by sensing the scent concentration of the added additive in the washing tub 10. The concentration sensor 100 may include a gas sensor, etc. capable of measuring the concentration of various chemical components contained in the additive.

It may be preferable that the concentration sensor 100 senses the scent concentration of an additive after a rinse cycle, among the main laundry cycles of the washing machine 1000, is completed. An additive such as a fabric softener may be added before a rinse cycle is started, and a chemical action caused by the fabric softener may occur during a laundry cycle that is performed before the rinse cycle.

A liquid component of the additive may be diluted with washing water and discharged during the rinse cycle, and some chemical component of the additive may remain in the laundry so that the laundry gives out a scent. Accordingly, a scent concentration of an additive measured before the rinse cycle is finished may differ from a scent concentration measured after the rinse cycle is finished, because the additive is not yet completely diluted before the rinse cycle is finished.

Since what users care about is the scent concentration of an additive after all the processes for the laundry are completed, the scent concentration of an additive has to be measured after the rinse cycle is completed, which is when the scent concentration no longer changes. Therefore, the concentration sensor 100 is configured to sense the scent concentration of an additive after the rinse cycle, among the main laundry cycles of the washing machine 1000, is completed.

The controller 200 may be configured to switch the washing tub 10 to an additional laundry cycle mode according to the scent concentration of an additive sensed by the concentration sensor 100. When it is determined that the amount of the additive, which is indirectly checked by the concentration sensor 100, does not meet the requirement of the user, the controller 200 may switch the washing tub 10 to the additional laundry cycle mode.

When the washing tub 10 is in the additional laundry cycle mode, an additional laundry cycle, apart from the laundry cycles preset by the user, may be performed. For example, when it is determined, after a preset rinse cycle is completed, that too much additive was added considering the preference of the user, a rinse cycle may be additionally performed. On the contrary, when it is determined, after the preset rinse cycle is completed, that relatively little additive was added considering the preference of the user, the additive may be additionally added. When the additive is additionally added, a rinse cycle may also be additionally performed, in order to dilute and discharge the additionally added additive. That is, when the washing tub 10 is in the additional laundry cycle mode, the additive may be additionally added or the rinse cycle, etc. may be additionally performed.

As described above, the controller 200 may switch the washing tub 10 to the additional laundry cycle mode when it is determined that the scent concentration of the additive measured in the washing tub 10 does not meet the requirement of the user. Accordingly, the washing machine 1000 may effectively check whether the amount of an additive used is appropriate considering the preference of each user.

In the washing machine 1000, the washing tub 10 may include an air outlet 11 formed to communicate with external air, and the concentration sensor 100 may be installed in (or at) the air outlet 11 so as to sense the scent concentration. As shown in FIG. 2, the air outlet 11 may be formed in the washing tub 10 such that the inside of the washing tub 10 communicates with external air. The air outlet 11 may be a kind of safety vent pipe, which when necessary may communicate with external air such that the inside of the washing tub 10 is not completely sealed.

The washing tub 10 may include an inner tub which rotates with the laundry therein, and an outer tub which covers the inner tub and is installed to be fixed with respect to the washing machine 1000. Accordingly, the air outlet 11 may be formed to the fixedly-installed outer tub of the washing tub 10, such that the washing tub 10 stably communicates with external air. Accordingly, considering that air flow in the washing tub 10 is highest at the air outlet 11 and there is no other air flow in the washing tub 10, it can be said that the air outlet 11 is the most appropriate position for the installation of the concentration sensor 100. As such, in the washing machine 1000 according to this embodiment, considering that the scent concentration of an additive is sensed in the air outlet 11, which is formed in the washing tub 10 so as to communicate with external air, the performance of sensing the scent concentration of an additive may be improved by installing the concentration sensor 100 at a position in the washing tub 10 where air flow is relatively high and the concentration sensor 100 can be stably installed.

Figure 3:
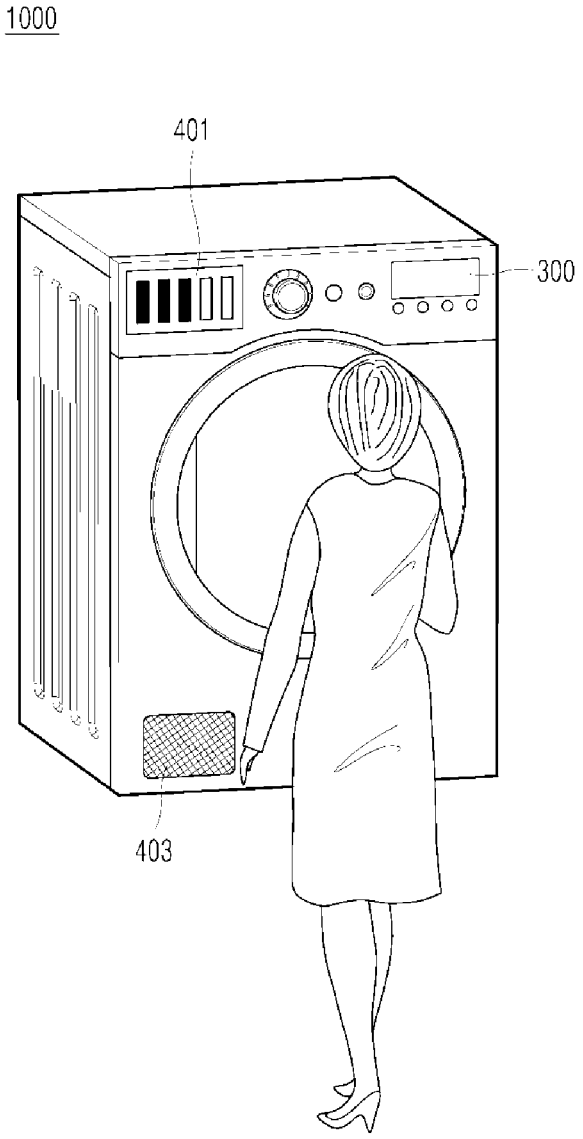
FIG. 3 is a view schematically illustrating an example of an information input interface and a notification output interface in the washing machine according to one embodiment of the present disclosure.

FIG. 3 is a view schematically illustrating an example of an information input interface and a notification output interface in the washing machine according to one embodiment of the present disclosure. The washing machine 1000 according to this embodiment may further include an information input interface 300 (or information input device) to which setting information regarding a desired scent concentration of the user is inputted. That is, the information input interface 300 may be installed in the washing machine 1000 as illustrated in FIG. 3, and the user may input setting information regarding a desired scent concentration through the information input interface 300. The setting information refers to information for setting a scent concentration of an additive according to the preference of the user, wherein the user may select a number or step for the desired scent concentration. That is, the user may set the scent concentration of an additive to fall within a reference range of concentration. Alternatively, the user may set the scent concentration of an additive to be any one of high concentration, medium concentration, or low concentration.

Although FIG. 3 illustrates an example in which the information input interface 300 is formed as a touch screen, the present disclosure is not limited thereto. The information input interface 300 may be formed as an input interface operating through a voice input or a remote controller, and may be configured in various ways as needed.

As such, the washing machine 1000 may be configured such that the user inputs the setting information regarding a desired scent concentration of an additive to the washing machine 1000 before laundry cycles are started. Accordingly, the washing machine 1000 may adjust the amount of the additive used according to the preference of each user.

The washing machine 1000 may further include notification output interfaces 401 and 403 (or notification output devices) configured to output notification information regarding the scent concentration sensed by the concentration sensor 100. In addition, feedback information of the user in response to the notification information may be inputted through the information input interface 300.

That is, as shown in FIG. 3, the notification output interfaces 401 and 403 may be installed in (or at) the washing machine 1000, and the notification information may be displayed to the user through the notification output interfaces 401 and 403. In response to the displayed notification information, the user may input feedback information through the information input interface 300.

The notification information refers to a notification that notifies the user of information on the sensed scent concentration, and may be outputted in the form of a visual signal, an auditory signal, or a combination thereof. For example, as shown in FIG. 3, the notification output interfaces 401 and 403 may include a screen installed in (or at) the washing machine 1000, to thereby output visual notification information when necessary. Alternatively, the notification output interfaces 401 and 403 may include a speaker installed in (or at) the washing machine 1000 so as to output auditory notification information when necessary.

The feedback information refers to information on whether the user wants the additional laundry cycle mode to be performed after checking the notification information. For example, after checking the notification information, the user may manipulate the washing machine 1000 such that an additive is additionally added or a rinse cycle is additionally performed.

Even when the notification information indicates that the sensed scent concentration does not meet the preference of the user, the user may manipulate the washing machine 1000 such that no additional laundry cycle is performed in order to reduce the operation time of the washing machine 1000. As such, the washing machine 1000 may output the sensing result of the scent concentration of an additive and receive an input of the feedback information of the user in response to the outputted sensing result. Accordingly, the user may quickly and easily check the state of the washing machine 1000 and select whether to operate an additional laundry cycle.

The washing machine 1000 may further include an information storage 600 (or memory) in which information on the additional laundry cycle is stored based on the feedback information. That is, as shown in FIG. 2, the information storage 600 may be installed in the washing machine 1000 to store therein the information on the additional laundry cycle through the above-described process.

The information on the additional laundry cycle refers to information on the additional laundry cycle that is selected by the user in response to the notification information, and may be information that, like the setting information initially inputted by the user, reflects the preference of the user.

Accordingly, when the user uses the washing machine 1000 at a later time, it is highly likely that the user will input the same setting information and select the same additional laundry cycle as before. Thus, if the user does not make any change when operating the washing machine 1000 at a later time, it may be preferable that the washing machine 1000 operates according to the previous information stored in the information storage 600. As such, the washing machine 1000 may perform an additional laundry cycle selected by the user, and the information on the additional laundry cycle may be stored in the information storage 600. Accordingly, when the washing machine 1000 is operated at a later time, the preference of the user may be reflected without the user having to input setting information.

Figure 4:
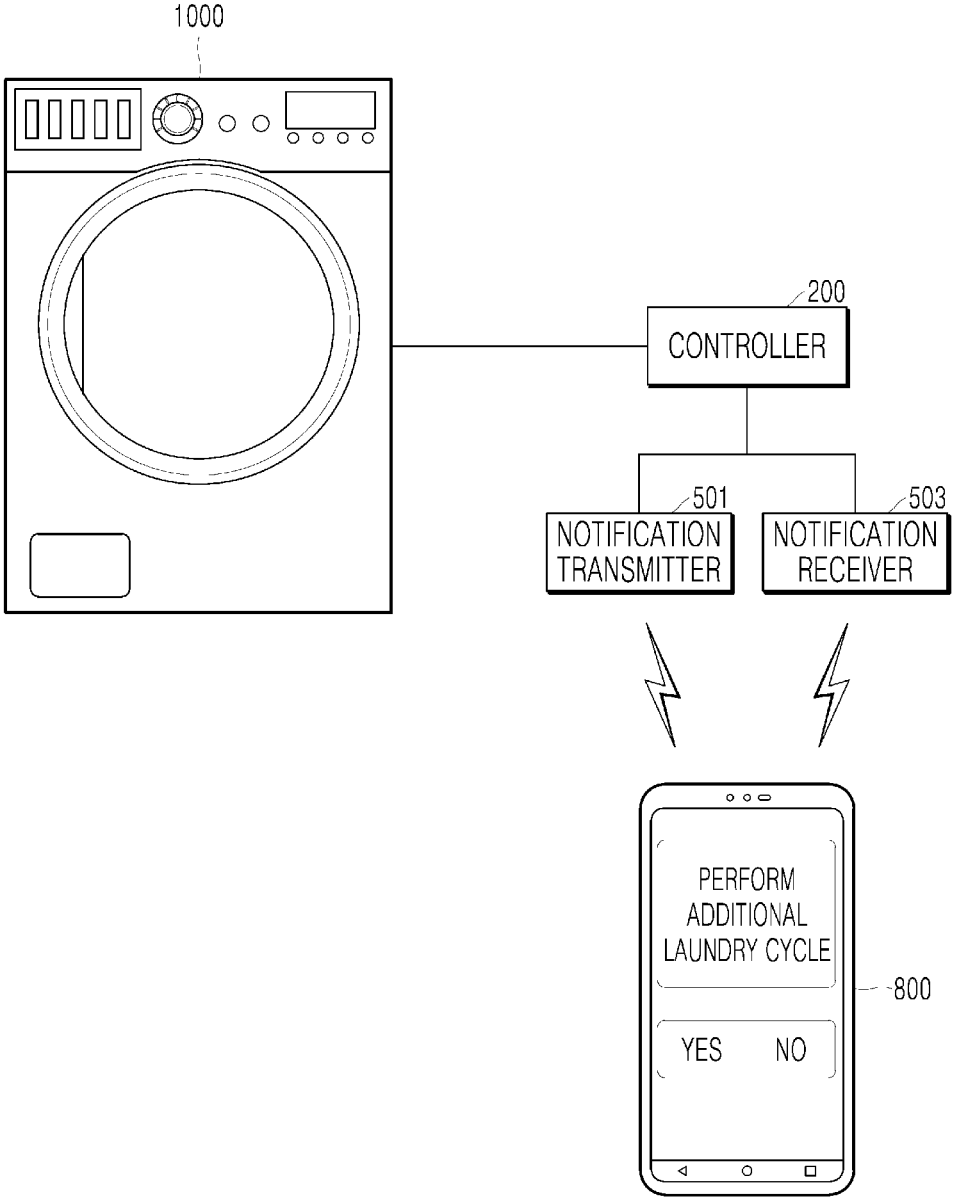
FIG. 4 is a diagram schematically illustrating an example of a notification transmitter and a notification receiver in the washing machine according to one embodiment of the present disclosure.

FIG. 4 is a diagram schematically illustrating an example of a notification transmitter and a notification receiver in the washing machine according to one embodiment of the present disclosure. The washing machine 1000 according to this embodiment may include a notification transmitter 501 configured to remotely transmit notification information on the scent concentration sensed by the concentration sensor 100 and a notification receiver 503 configured to receive feedback information of the user (remotely located) in response to the notification information.

For example, as shown in FIG. 4, the notification transmitter 501 and the notification receiver 503 may be installed in (or at) the washing machine 1000. The notification information may be transmitted through the notification transmitter 501 to a terminal 800 carried by the user. The transmitted notification information may then be outputted on the terminal 800 in the form of a visual signal, an auditory signal, or a combination thereof.

The user may check the notification information at the terminal 800, and may input feedback information through the terminal 800. The inputted feedback information may be remotely received by the notification receiver 503, and the washing machine 1000 may be controlled according to the feedback information.

As such, the washing machine 1000 may remotely transmit a sensing result of the scent concentration of an additive and receive remote feedback information in response thereto. Accordingly, even when the user is in a location distant from the washing machine 1000, the user may check the state of the washing machine 1000 and select whether to perform an additional laundry cycle. That is, even when the user is in a location distant from the washing machine 1000, the washing machine 1000 may perform an additional laundry cycle according to a selection of the user, and information on the additional laundry cycle may be stored.

Figure 5:
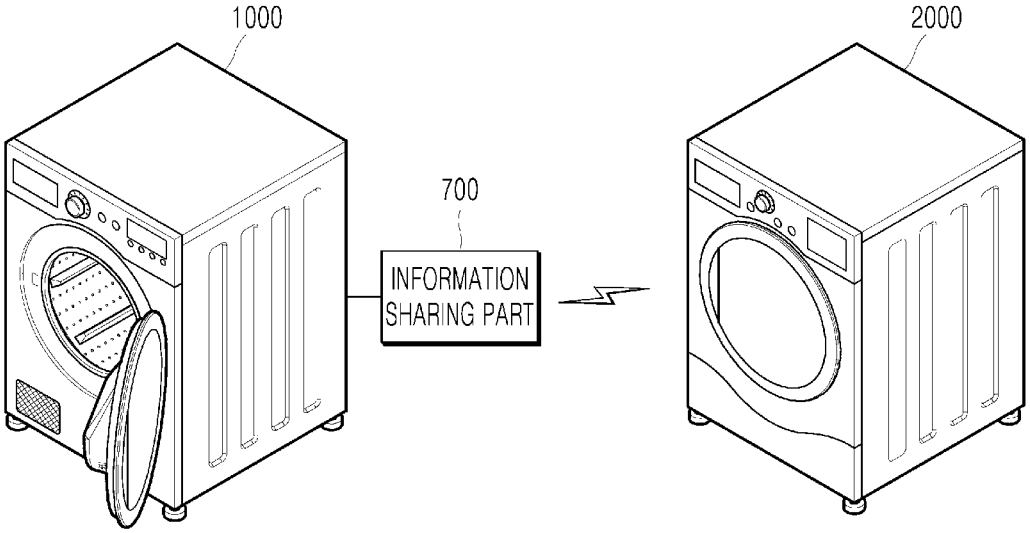
FIG. 5 is a view illustrating an example of an information sharing part in the washing machine according to one embodiment of the present disclosure.

FIG. 5 is a view illustrating an example of an information sharing part of the washing machine according to one embodiment of the present disclosure. The washing machine 1000 according to this embodiment may further include an information sharing part 700 (or information sharing device) configured to synchronize setting information reflecting information on the additional laundry cycle with a neighboring device 2000 capable of communicating with the washing machine 1000. That is, the information sharing part 700 may be installed at the washing machine 1000 as shown in FIG. 5, and the setting information may be transmitted through the information sharing part 700 to the neighboring device 2000.

The neighboring device 2000 may be a device capable of performing a process for the laundry subsequent to the cycles of the washing machine 1000. For example, the neighboring device 2000 may be a drying machine or a Styler. The neighboring device 2000 may be configured to communicate with the washing machine 1000, may receive the setting information transmitted from the information sharing part 700, and may be controlled according to the received setting information. For example, when the setting information indicates that the user prefers a relatively strong scent of an additive, it may not be preferable to dry the laundry in the drying machine at a relatively high temperature, because much of the scent of the additive may be evaporated in such a high-temperature drying process. Accordingly, the drying machine that has received the setting information indicating that the user prefers a relatively strong scent of the additive from the washing machine 1000 may be controlled such that as little scent of the additive as possible is evaporated.

As described above, since the washing machine 1000 according to this embodiment transmits the setting information reflecting the information on the additional laundry cycle to a neighboring device that performs a subsequent process for the laundry, not only the washing machine 1000 but also the neighboring device may appropriately reflect the preference of the user.

Figure 6:
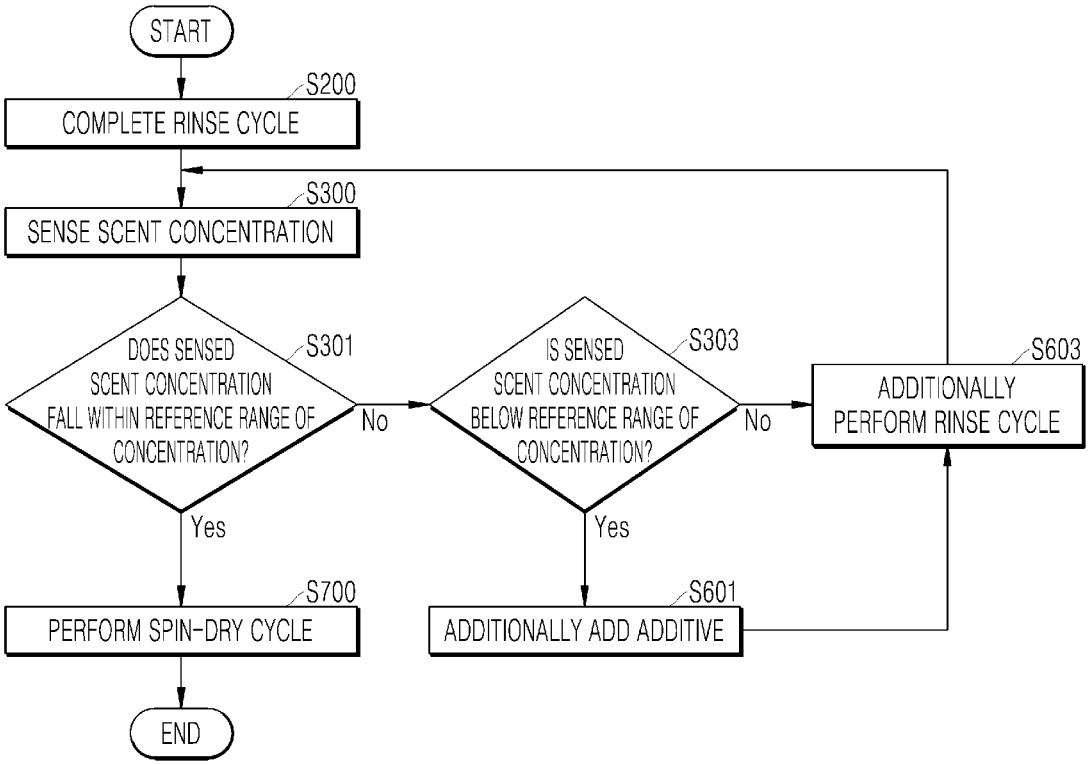
FIG. 6 is a flowchart illustrating a control method of a washing machine according to one embodiment of the present disclosure.

FIG. 6 is a flowchart illustrating a control method of a washing machine according to one embodiment of the present disclosure. The control method includes main features of the washing machine 1000 described in detail above. Therefore, the description below will be made referring to FIGS. 1 to 5.

First, a rinse cycle of the laundry may be completed (S200). That is, after the wash cycle and the rinse cycle of the laundry are completed, S300 described below may be performed. Since what users care about is the scent concentration of an additive after all the processes of the laundry have been completed, the scent concentration of the additive has to be measured after the rinse cycle is completed, which is when the scent concentration no longer changes.

Thereafter, the scent concentration of the additive may be sensed in the washing tub 10 (S300). That is, the scent concentration of the additive added to the washing tub 10 may be sensed, so as to indirectly check the amount of the additive used. It may be checked whether the sensed scent concentration falls within a predetermined reference range of concentration (S301). When it is determined in S301 that the sensed scent concentration does not fall within the reference range of concentration, it may then be determined whether the sensed scent concentration is below the reference range of concentration (S303). When it is determined in S301 and S303 that the sensed scent concentration is neither in the reference range of concentration nor below the reference range of concentration, it may be determined that the sensed scent concentration exceeds the reference range of concentration.

Thereafter, according to the sensed scent concentration, the washing tub 10 may be switched to an additional laundry cycle mode (S601 and S603). That is, when it is determined that the amount of the additive, which is indirectly checked through the sensed scent concentration, does not meet the preference of the user, the washing tub 10 may be switched to the additional laundry cycle mode. When it is determined in S301 that the sensed scent concentration falls within the reference range of concentration, a spin-dry cycle may be performed (S700). That is, when it is determined in S301 that the sensed scent concentration meets the preference of the user, the control method of a washing machine may proceed to the originally planned spin-dry cycle, without performing an additional laundry cycle.

As described above, the control method of a washing machine according to this embodiment may perform the spin-dry cycle when the sensed scent concentration meets the preference of the user. Accordingly, unnecessary performance of an additional laundry cycle may be prevented. When it is determined in S303 that the sensed scent concentration is below the reference range of concentration, the additive may be additionally added (S601). That is, when it is determined, after the preset rinse cycle is completed, that relatively little additive was added considering the preference of the user, the additive may be additionally added.

As described above, in the control method of a washing machine according to this embodiment, when it is determined that the scent of the additive is relatively weak considering the requirement of the user, the additive may be additionally added to increase the scent concentration of the additive, to thereby meet the preference of the user.

A rinse cycle, together with the addition of the additive, may also be additionally performed in order to dilute and drain the additionally added additive (S603).

When it is determined in S301 and S303 that the sensed scent concentration exceeds the reference range of concentration, an additional rinse cycle may be performed (S603). That is, when it is determined, after a preset rinse cycle is completed, that too much additive was added considering the preference of the user, a rinse cycle may be additionally performed.

As such, in the control method of a washing machine according to this embodiment, when it is determined that the scent of the additive is relatively strong considering the requirement of the user, a rinse cycle may be additionally performed to decrease the scent concentration of the additive, to thereby meet the preference of the user.

Figure 7:
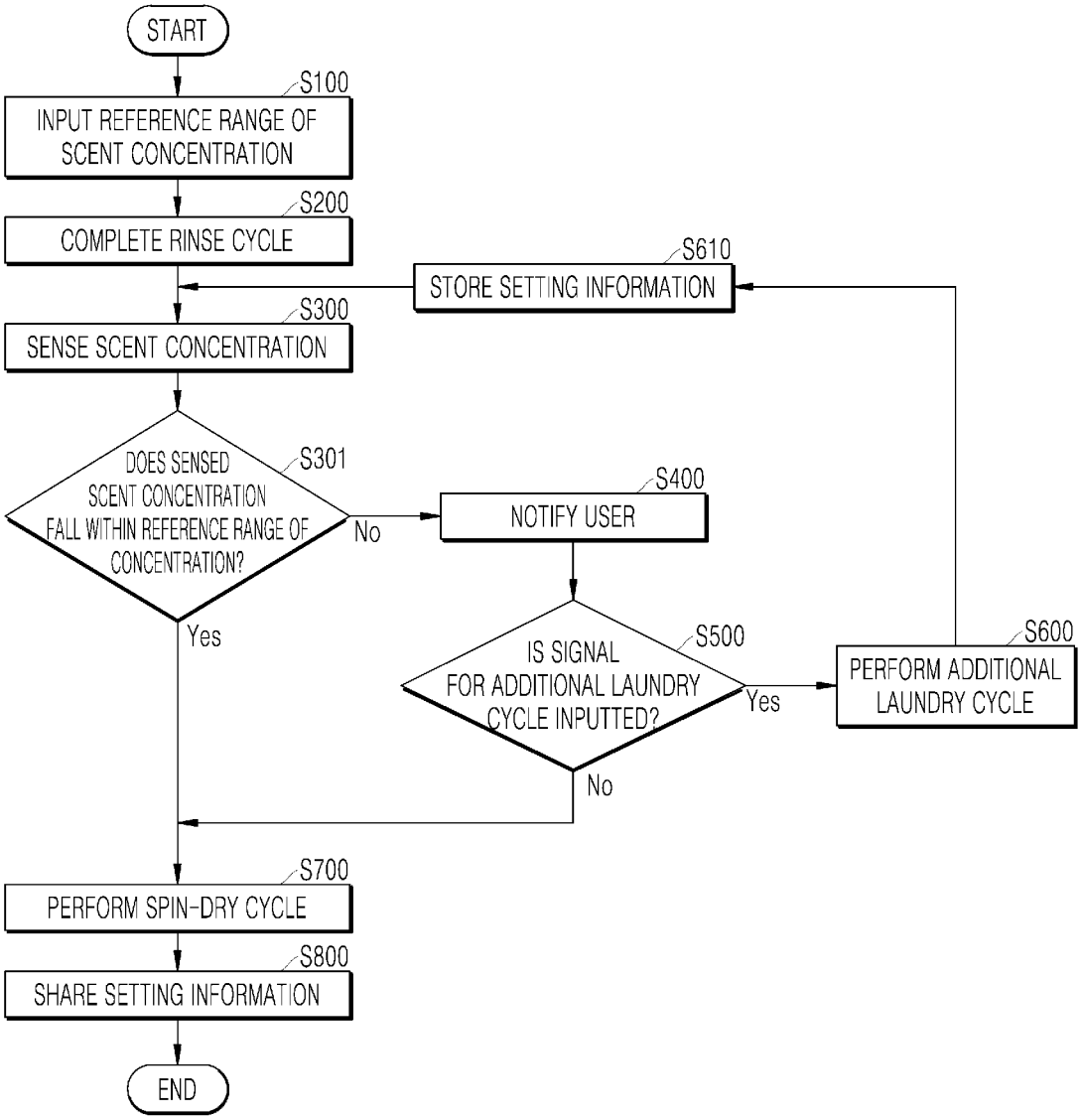
FIG. 7 is a flowchart illustrating a control method of a washing machine according to another embodiment of the present disclosure.

FIG. 7 is a flowchart illustrating a control method of a washing machine according to another embodiment of the present disclosure. The control method of a washing machine according to this embodiment of the present disclosure will be described with reference to FIG. 7. The control method of a washing machine according to this embodiment also include the main features of the washing machine 1000 described in detail above. Therefore, the description below will be made referring to FIGS. 1 to 5 together.

First, setting information regarding the scent concentration may be inputted (S100). That is, the user may input, to the washing machine 1000, the setting information regarding a desired scent concentration of an additive before laundry cycles of the washing machine 1000 are started. Accordingly, the amount of the additive used may be adjusted according to the preference of each user.

Subsequently, a rinse cycle of the laundry may be completed (S200). Thereafter, the scent concentration of the additive may be sensed in the washing tub 10 (S300). Here, it may be checked whether the sensed scent concentration falls within a predetermined reference range of concentration (S301). It is determined in S301 that the sensed scent concentration falls within the reference range of concentration, a spin-dry cycle may be performed (S700). On the contrary, when it is determined in S301 that the sensed scent concentration does not fall within the reference range of concentration, such determination may be notified to the user (S400). In S400, a sensing result of the scent concentration of the additive may be outputted to the user. Alternatively, in S400, the sensing result of the scent concentration of the additive may be remotely transmitted to the user.

After checking the sensing result of the scent concentration of the additive in S400, the user may input feedback information in response to the sensing result (S500). S500 may be performed as the user approaches the washing machine 1000 and directly inputs the feedback information to the washing machine 1000. Alternatively, S500 may be performed as the washing machine 1000 remotely receives the feedback information from the user.

As such, in the control method of a washing machine according to this embodiment, the sensing result of the scent concentration of the additive may be notified to the user in the process of doing the laundry, and in response to the notification, the user may select whether to perform an additional laundry cycle. Accordingly, the amount of the additive used may be appropriately adjusted so as to meet the preference of each user even in the process of doing the laundry.

The user may not input a signal for an additional laundry cycle in S500. That is, even when the notification information indicates that the sensed scent concentration does not meet the preference of the user, the user may manipulate the washing machine 1000 such that no additional laundry cycle is performed, and the originally planned spin-dry cycle is performed, in order to reduce the operation time of the washing machine 1000.

On the contrary, when the user inputs a signal for an additional laundry cycle in S500, the washing machine 1000 may perform the inputted additional laundry cycle (S600). That is, in S600, the additive may be additionally added, or an additional rinse cycle may be performed.

When an additional laundry cycle is performed in S600, information on the additional laundry cycle may be stored based on the feedback information (S610). That is, when an additional laundry cycle is performed according to a selection of the user, the information on the additional laundry cycle may be stored, such that when the user uses the washing machine 1000 at a later time, the preference of the user is reflected without the user having to input setting information.

When S700 is completed after above-described processes, the setting information including the information on the additional laundry cycle may be synchronized with the neighboring device 2000 capable of communicating with the washing machine 1000 (S800).

That is, the setting information including the information on the additional laundry cycle may be transmitted to a device that performs a subsequent process of the laundry, such that not only the washing machine 1000 but also the device that performs a subsequent process of the laundry reflects the preference of the user.

The present disclosure is directed to addressing shortcomings of existing washing machines. The present disclosure is directed to providing a washing machine and a control method of a washing machine characterized in that scent concentration of an additive used for laundry may be sensed, and it may be effectively determined whether the sensed scent concentration of the additive is appropriate considering the preference of each user.

The present disclosure is directed to providing a washing machine and a control method of a washing machine characterized in that before laundry cycles are started, an additive may be added to a washing tub on the basis of preference of each user.

The present disclosure is directed to providing a washing machine and a control method of a washing machine characterized in that even while a laundry cycle is being performed, the amount of an additive added to the washing tub may be based on the preference of each user, to thereby meet the requirement of each user.

Aspects of the present disclosure are not limited to what have been described above, and other aspects not mentioned above will be apparent from the following description to those skilled in the art to which the present disclosure pertains.

A washing machine and a control method thereof according to one aspect of the present disclosure are characterized in that a scent concentration of an additive is sensed in the washing tub, and the washing machine may be controlled according to the sensed scent concentration. Specifically, in response to a determination that the scent concentration of an additive sensed in the washing tub does not meet the requirement of the user, the washing tub may be switched to an additional laundry cycle mode.

The washing machine and the control method thereof according to one aspect of the present disclosure are characterized in that each user may set a desired scent concentration of an additive before laundry cycles are started. Specifically, before laundry cycles are started, the user may input, to the washing machine, setting information regarding the desired scent concentration of an additive.

The washing machine and the control method thereof according to one aspect of the present disclosure are characterized in that the user may check whether a laundry cycle is being performed on the basis of the desired scent concentration of the user, and may adjust the scent concentration of the additive. Specifically, while a laundry cycle is being performed, the user may be notified of a result of sensing the scent concentration of the additive, and then may select whether to operate an additional laundry cycle based on the sensing result.

Additionally, the washing machine and the control method thereof according to one aspect of the present disclosure are characterized in that the scent concentration of an additive may be sensed in an air outlet which is formed in the washing tub so as to communicate with external air.

The washing machine and the control method thereof according to one aspect of the present disclosure are characterized in that the sensing result of the scent concentration of an additive may be outputted, and in response to the sensing result, the user may input feedback information.

The washing machine and the control method thereof according to one aspect of the present disclosure are characterized in that the sensing result of the scent concentration of an additive may be remotely transmitted, and the feedback information in response to the sensing result may be remotely received.

Additionally, the washing machine and the control method thereof according to one aspect of the present disclosure are characterized in that an additional laundry cycle may be performed according to a selection of the user, and information on the additional laundry cycle may be stored.

The washing machine and the control method thereof according to one aspect of the present disclosure are characterized in that setting information reflecting the information on the additional laundry cycle may be transmitted to a device that performs a subsequent process for the laundry.

The washing machine and the control method thereof according to one aspect of the present disclosure are characterized in that in response to the sensed scent concentration of the additive meeting a requirement of the user, a spin-dry cycle may be performed.

The washing machine and the control method thereof according to one aspect of the present disclosure are characterized in that in response to a determination that the sensed scent concentration of the additive is relatively low considering the requirement of the user, the additive may be additionally added.

Additionally, the washing machine and the control method thereof according to one aspect of the present disclosure are characterized in that in response to a determination that the sensed scent concentration of the additive is relatively high considering the requirement of the user, a rinse cycle may be additionally performed.

Aspects that can be achieved by the present disclosure are not limited to what has been described above, and other aspects can be clearly understood from the following description by those skilled in the art to which the present disclosure pertains.

Effects of the washing machine and the control method thereof according to the present disclosure are as follows. According to at least one of the embodiments of the present disclosure, in response to a determination that a result of sensing the scent concentration of an additive does not meet the requirement of the user, the washing tub may be switched to an additional laundry cycle mode. Accordingly, it may be effectively checked whether the amount of an additive used is appropriate considering the preference of each user.

According to at least one of the embodiments of the present disclosure, the user may input setting information regarding a desired scent concentration of an additive to the washing machine before laundry cycles are started. Accordingly, the amount of the additive used may be appropriately adjusted according to the preference of each user.

According to at least one of the embodiments of the present disclosure, a sensing result of the scent concentration of an additive may be notified to the user while a laundry cycle is being performed, and in response to the notification, the user may select whether to perform an additional laundry cycle. Accordingly, the amount of the additive used may be adjusted so as to meet the preference of each user even while a laundry cycle is being performed.

According to at least one of the embodiments of the present disclosure, since a concentration sensor configured to sense the scent concentration of an additive is installed in an air outlet which is formed in the washing tub so as to communicate with external air, performance of sensing the scent concentration of an additive may be improved.

According to at least one of the embodiments of the present disclosure, the sensing result of the scent concentration of an additive may be outputted, and in response to the sensing result, the user may input feedback information. Accordingly, the user may quickly and easily check the state of the washing machine and select whether to perform an additional laundry cycle.

According to at least one of the embodiments of the present disclosure, the sensing result of the scent concentration of an additive may be remotely transmitted, and the feedback information in response to the sensing result may be remotely received. Accordingly, even when the user is in a location distant from the washing machine, the user may check the state of the washing machine and select whether to perform an additional laundry cycle.

According to at least one of the embodiments of the present disclosure, an additional laundry cycle may be performed according to the selection of the user, and the information on the additional laundry cycle may be stored, such that when the washing machine is operated at a later time, the preference of the user is reflected without the user having to input setting information to the washing machine.

According to at least one of the embodiments of the present disclosure, the setting information including the information on the additional laundry cycle may be transmitted to a device that performs a subsequent process for the laundry. Accordingly, not only the washing machine but also the devices performing subsequent processes for the laundry may appropriately reflect the preference of the user.

According to at least one of the embodiments of the present disclosure, the spin-dry cycle may be performed when the sensed scent concentration meets the preference of the user. Accordingly, an unnecessary performance of an additional laundry cycle may be prevented.

According to at least one of the embodiments of the present disclosure, in response to a determination that the sensed scent concentration of an additive is relatively low considering the requirement of the user, the additive may be additionally added so as to increase the scent concentration of the additive, to thereby meet the preference of the user.

According to at least one of the embodiments of the present disclosure, in response to a determination that the sensed scent concentration of an additive is relatively high considering the requirement of the user, a rinse cycle may be additionally performed so as to decrease the scent concentration of the additive, to thereby meet the preference of the user.

The shapes, sizes, ratios, angles, the number of elements given in the drawings are merely exemplary, and thus, the present disclosure is not limited to the illustrated details. Like reference numerals designate like elements throughout the specification.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of:" For example, the expression "at least one of A, B, and C" may also include an nth member, where n is greater than 3, whereas the expression "at least one selected from the group consisting of A, B, and C" does not.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a washing tub to receive laundry, and to perform a plurality of laundry cycles;

an additive supplying device to couple to the washing tub to provide an additive to the washing tub;

a concentration sensor configured to sense a scent concentration of the additive in the washing tub; and a controller configured to:

control the washing machine to perform a rinse cycle; and after performing the rinse cycle, change the washing tub to perform an additional laundry cycle based on the scent concentration sensed by the concentration sensor.

2. The washing machine of claim 1, wherein the washing tub includes an air outlet configured to communicate with external air, and the concentration sensor is disposed at the air outlet so as to sense the scent concentration.

3. The washing machine of claim 1, comprising an information input interface to which receive setting information regarding scent concentration of at least one additive.

4. The washing machine of claim 3, comprising a notification output interface configured to output notification information based on the scent concentration sensed by the concentration sensor, wherein in response to the notification information, the information input interface is to receive feedback information.

5. The washing machine of claim 3, comprising:

a notification receiver configured to receive feedback information in response to the notification information.

6. The washing machine of claim 4, comprising an information storage to store information on an additional laundry cycle based on the feedback information.

7. The washing machine of claim 6, comprising an information sharing device configured to synchronize the setting information on an additional laundry cycle with a neighboring device capable of communicating with the washing machine.

* * * * *